US009018853B2

(12) United States Patent
Johannessen et al.

(10) Patent No.: US 9,018,853 B2
(45) Date of Patent: Apr. 28, 2015

(54) METHODS, APPARATUS AND ARTICLES OF MANUFACTURE TO CALIBRATE LIGHTING UNITS

(71) Applicant: B/E Aerospace, Inc., Wellington, FL (US)

(72) Inventors: Eric Johannessen, Bohemia, NY (US); Andrew B. Walsh, East Islip, NY (US); Kevin Lawrence, Port Jefferson Station, NY (US); Richard Waring, Jr., West Sayville, NY (US)

(73) Assignee: B/E Aerospace, Inc., Wllington, FL (US)

( * ) Notice: Subject to any disclaimer, the term of this patent is extended or adjusted under 35 U.S.C. 154(b) by 0 days.

(21) Appl. No.: 13/650,289

(22) Filed: Oct. 12, 2012

(65) Prior Publication Data

US 2013/0038241 A1 Feb. 14, 2013

Related U.S. Application Data

(63) Continuation-in-part of application No. 13/035,329, filed on Feb. 25, 2011, and a continuation-in-part of application No. 12/566,146, filed on Sep. 24, 2009, now Pat. No. 8,378,595.

(Continued)

(51) Int. Cl.
*H05B 37/02* (2006.01)
*H05B 33/08* (2006.01)

(52) U.S. Cl.
CPC ..... *H05B 33/0827* (2013.01); *H05B 33/0869* (2013.01)

(58) Field of Classification Search
CPC ..... H05B 33/0815; H05B 33/0818; H05B 37/029
See application file for complete search history.

(56) References Cited

U.S. PATENT DOCUMENTS

| | | | |
|---|---|---|---|
| 4,729,742 | A | 3/1988 | Onishi et al. |
| 5,003,432 | A | 3/1991 | Mandy |
| 5,490,048 | A | 2/1996 | Brassier et al. |
| 5,677,603 | A | 10/1997 | Speirs et al. |

(Continued)

FOREIGN PATENT DOCUMENTS

| | | | |
|---|---|---|---|
| EP | 1901587 | A2 | 3/2008 |
| JP | 2003-524284 | A | 8/2003 |

(Continued)

*Primary Examiner* — Jason M Crawford
*Assistant Examiner* — Nelson Correa
(74) *Attorney, Agent, or Firm* — Drinker Biddle & Reath LLP

(57) ABSTRACT

A system and appertaining method calibrate a color LED light unit comprising at least first-, second-, and third-color LEDs, comprising: a) defining a target color on a color map to calibrate; b) selecting initial calibration coefficients associated with the target color; c) storing the initial or updated calibration coefficients in a non-volatile memory of the light unit; d) controlling the light unit to drive the LEDs to attempt to emit the target color, producing an attempted color, utilizing the calibration coefficients; e) measuring the attempted color to determine if it matches the target color within a predefined tolerance; f) if the attempted color matches the target color, then terminating the method; g) if the attempted color does not match the target color, then performing the following; h) selecting a color component; i) adapting at least one calibration coefficient associated with the selected color component; and j) performing (c)-(i) again.

16 Claims, 5 Drawing Sheets

Related U.S. Application Data

(60) Provisional application No. 61/546,259, filed on Oct. 12, 2011, provisional application No. 61/345,378, filed on May 17, 2010, provisional application No. 61/320,545, filed on Apr. 2, 2010, provisional application No. 61/308,171, filed on Feb. 25, 2010, provisional application No. 61/105,506, filed on Oct. 15, 2008, provisional application No. 61/099,713, filed on Sep. 24, 2008.

(56) References Cited

U.S. PATENT DOCUMENTS

| | | | | |
|---|---|---|---|---|
| 6,016,038 | A | 1/2000 | Mueller et al. | |
| 6,211,626 | B1 | 4/2001 | Lys et al. | |
| 6,220,721 | B1 | 4/2001 | Chan et al. | |
| 6,815,842 | B2 | 11/2004 | Fehd et al. | |
| 7,081,925 | B2 * | 7/2006 | Yang et al. | 348/655 |
| 7,114,827 | B2 | 10/2006 | Halter | |
| 7,161,556 | B2 | 1/2007 | Morgan et al. | |
| 7,173,383 | B2 * | 2/2007 | Vornsand et al. | 315/291 |
| 7,198,387 | B1 | 4/2007 | Gloisten et al. | |
| 7,266,315 | B2 | 9/2007 | Sato | |
| 7,375,476 | B2 * | 5/2008 | Walter et al. | 315/312 |
| 7,443,104 | B2 * | 10/2008 | Zwanenburg et al. | 315/209 R |
| 7,494,255 | B2 | 2/2009 | Bryan et al. | |
| 7,515,128 | B2 * | 4/2009 | Dowling | 345/83 |
| 7,658,506 | B2 | 2/2010 | Dowling | |
| 7,696,964 | B2 * | 4/2010 | Lankhorst et al. | 345/82 |
| 7,717,593 | B2 | 5/2010 | Clark | |
| 7,717,594 | B2 | 5/2010 | Clark | |
| 7,718,942 | B2 * | 5/2010 | Lim et al. | 250/205 |
| 7,744,242 | B2 * | 6/2010 | Kramer | 362/231 |
| 7,893,633 | B2 * | 2/2011 | Pedersen | 315/318 |
| 8,264,448 | B2 * | 9/2012 | Shteynberg et al. | 345/102 |
| 8,278,846 | B2 * | 10/2012 | Roberts et al. | 315/308 |
| 2003/0208764 | A1 | 11/2003 | Galipeau et al. | |
| 2004/0183480 | A1 | 9/2004 | Halter | |
| 2004/0240211 | A1 | 12/2004 | Rodgers et al. | |
| 2005/0174309 | A1 | 8/2005 | Bouwens et al. | |
| 2005/0202785 | A1 | 9/2005 | Meyer | |
| 2005/0275912 | A1 | 12/2005 | Chen et al. | |
| 2006/0187081 | A1 | 8/2006 | Gloisten et al. | |
| 2007/0034775 | A1 | 2/2007 | Cheng et al. | |
| 2007/0097675 | A1 | 5/2007 | Koren et al. | |
| 2007/0103646 | A1 | 5/2007 | Young | |
| 2007/0139941 | A1 | 6/2007 | Bryan et al. | |
| 2007/0274084 | A1 | 11/2007 | Kan et al. | |
| 2007/0291483 | A1 | 12/2007 | Lys | |
| 2008/0089071 | A1 | 4/2008 | Wang et al. | |
| 2008/0136334 | A1 | 6/2008 | Robinson et al. | |
| 2008/0215279 | A1 | 9/2008 | Salsbury et al. | |
| 2008/0266887 | A1 | 10/2008 | Wentland et al. | |
| 2009/0001251 | A1 | 1/2009 | Ng et al. | |
| 2009/0059610 | A1 | 3/2009 | Marshall et al. | |
| 2009/0140630 | A1 | 6/2009 | Kijima et al. | |
| 2009/0251898 | A1 | 10/2009 | Kinnune et al. | |
| 2010/0007588 | A1 | 1/2010 | Zygmunt et al. | |
| 2012/0019164 | A1 * | 1/2012 | Gambeski et al. | 315/294 |
| 2013/0076250 | A1 * | 3/2013 | Logiudice | 315/161 |

FOREIGN PATENT DOCUMENTS

| | | | |
|---|---|---|---|
| JP | 2004-006253 | A | 1/2004 |
| JP | 2004-158370 | A | 6/2004 |
| JP | 2005-517278 | A | 6/2005 |
| JP | 2007-109584 | A | 4/2007 |
| JP | 2007-249647 | A | 9/2007 |
| JP | 2008-109514 | A | 5/2008 |
| JP | 2008-135224 | A | 6/2008 |
| WO | 03/067934 | A2 | 8/2003 |
| WO | 2008/047335 | A1 | 4/2008 |
| WO | 2009/035493 | A1 | 5/2009 |

* cited by examiner

METHODS, APPARATUS AND ARTICLES OF MANUFACTURE TO CALIBRATE LIGHTING UNITS

CROSS-REFERENCE TO RELATED APPLICATIONS

This application is a continuation-in-part of parent application Ser. No. 13/035,329, filed Feb. 25, 2011, which is a continuation-in-part of U.S. patent application Ser. No. 12/566,146, filed on Sep. 24, 2009, which claims the priority benefit of U.S. Provisional Application No. 61/099,713, filed Sep. 24, 2008, entitled, "An Aircraft LED Washlight System and Method for Controlling Same" and U.S. Provisional Application No. 61/105,506, filed Oct. 15, 2008, entitled, "An Aircraft LED Washlight System and Method for Controlling Same." The present application claims the priority benefit of the above-referenced applications, and also claims the priority benefit of U.S. Provisional Application No. 61/308,171, filed Feb. 25, 2010, entitled "Lighting System for Vehicle Cabin," U.S. Provisional Application No. 61/320,545, filed Apr. 2, 2010, entitled "Lighting System for Vehicle Cabin," U.S. Provisional Application No. 61/345,378, filed May 17, 2010, entitled "Lighting System for Vehicle Cabin," and U.S. Provisional Application No. 61/546,259, filed Oct. 12, 2011, entitled "Methods, Apparatus and Articles of Manufacture to Calibrate Lighting Units." All of the above-referenced applications are herein incorporated by reference in their entirety.

BACKGROUND

A lighting unit may be implemented using a plurality of different colored light sources such as different colored light emitting diodes (LEDs). For example, a lighting unit may include a white LED, a red LED, a blue LED and a green LED. Because of manufacturing process variations, the color emitted by a particular LED may differ from its intended or nominal color. For example, blue LEDs may not all emit the same color or intensity of blue light. Accordingly, different lighting units may emit different colors of light given the same control inputs. For example, when controlled to emit green light, a first lighting unit may emit a blue-tinted green light, while another lighting unit may emit a red-tinted green light. When a plurality of such lighting units is combined to light a space such as an airplane cabin, the color of light emitted throughout the cabin may display unacceptable variation in color or intensity.

Conventional solutions to overcome these problems include the screening of light sources (e.g., LEDs) to reduce variability in emitted light color to acceptable tolerances. However, such screening may result in unacceptable costs and/or manufacturing yields. Another conventional solution calibrates lighting units to achieve color consistency for a small number of fixed colors of light. However, such conventional calibration methods prevent multi-colored lighting units from being used to their fullest potential, and prevent users from creating customized lighting conditions.

SUMMARY

Methods, apparatus and articles of manufacture to calibrate lighting units that overcome at least these problems are disclosed herein. In particular, lighting units calibrated and operated according to the examples disclosed herein are able to consistently and reliable generate a gamut of colored light without need to screen light sources.

Accordingly, a method is provided for calibrating a color LED light unit comprising at least first-, second-, and third-color LEDs, comprising: a) defining a target color on a color map to calibrate; b) selecting initial calibration coefficients associated with the target color; c) storing the initial or updated calibration coefficients in a non-volatile memory of the light unit; d) controlling the light unit to drive the LEDs to attempt to emit the target color, producing an attempted color, utilizing the calibration coefficients; e) measuring the attempted color to determine if it matches the target color within a predefined tolerance; f) if the attempted color matches the target color, then terminating the method; g) if the attempted color does not match the target color, then performing the following; h) selecting a color component; i) adapting at least one calibration coefficient associated with the selected color component; and j) performing (c)-(i) again.

A non-transitory computer program product is also provided, comprising a computer usable medium having a computer readable program code embodied therein, said computer readable program code adapted to be executed to implement the method described above.

A system for calibrating a color LED light unit is also provided, wherein: the color LED light unit comprises: at least first-, second-, and third-color LEDs; and a non-volatile memory; and the system comprises: a) a target defining unit that defines a target color on a color map to calibrate; b) an assigning unit that selects initial calibration coefficients associated with the target color and stores the initial or updated calibration coefficients in the non-volatile memory; c) a controller that controls the light unit to drive the LEDs to attempt to emit the target color, producing an attempted color, utilizing the calibration coefficients; d) a sensor that measures the attempted color to determine if it matches the target color within a predefined tolerance; and e) a selection and adaption unit configured such that: f) if the attempted color matches the target color, then the system ceases performing calibration; g) if the attempted color does not match the target color, then a selection unit selects a color component, and an adaption unit adapts at least one calibration coefficient associated with the selected color component.

BRIEF DESCRIPTION OF THE DRAWINGS

Features and advantages of this disclosure will become apparent by describing in detail exemplary embodiments with reference to the attached drawings in which.

DETAILED DESCRIPTION

Exemplary embodiments will now be described more fully with reference to the accompanying drawings.

Figure 1:
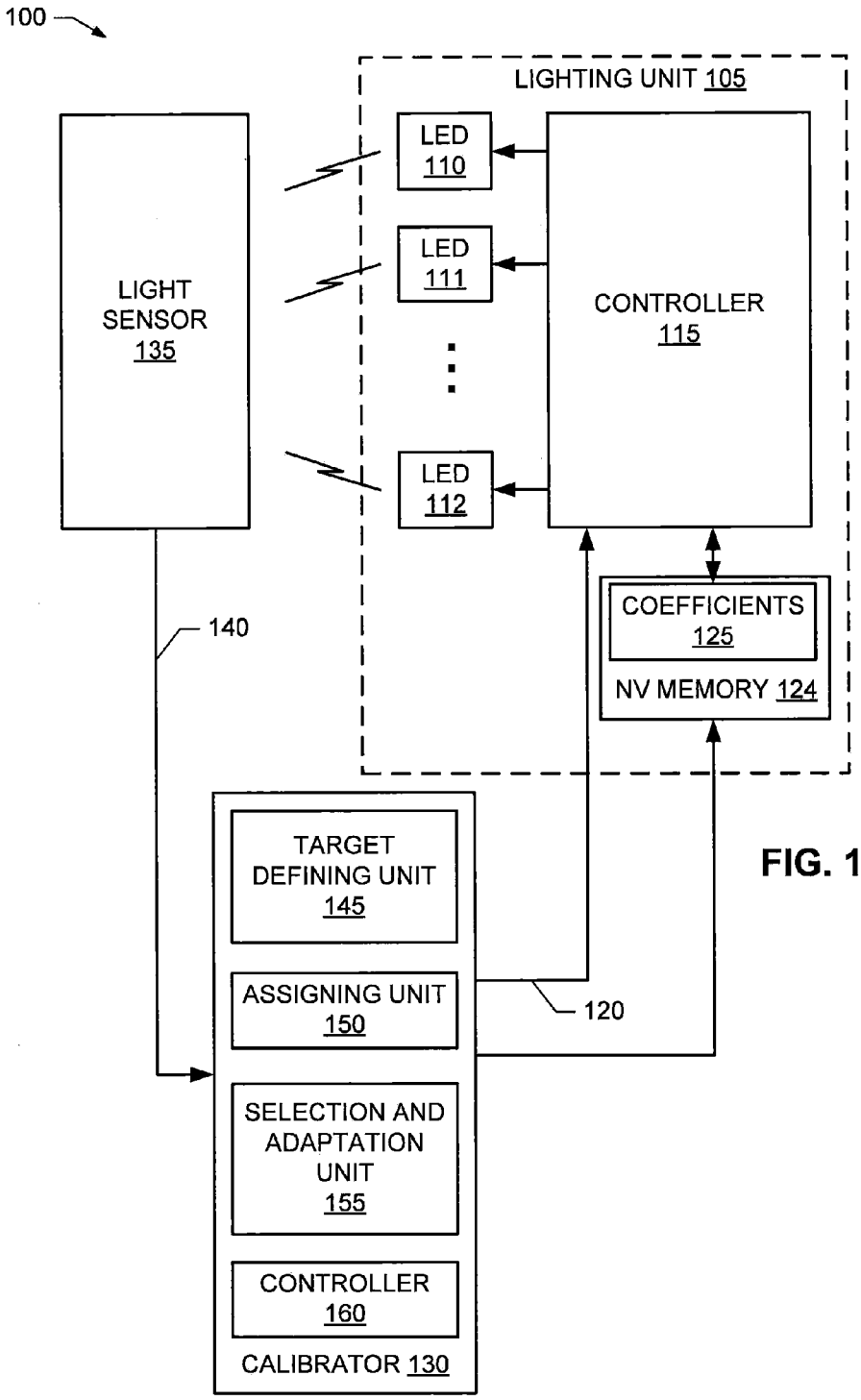
FIG. 1 is a schematic illustration of an example apparatus that may be used to calibrate a lighting unit.

FIG. 1 is a schematic illustration of an example apparatus 100 that may be used to calibrate a lighting unit 105. To emit multi-colored light, the example lighting unit 105 of FIG. 1 includes a plurality of different colored light sources 110-112. Example light sources 110-112 include an LED, an organic light emitting diodes (OLED), or the like. Thus, for instance, the lighting unit 105 may include a white LED, a red LED, a blue LED and a green LED. The white LED is optional, but can be advantageously, included because it has a high color rendering index. Furthermore, the invention is not limited to the use of red, blue, and green LEDs, but rather could incorporate an arbitrary first color, second color, and third color LED. Other numbers and/or color combinations of light sources may be used.

To generate different colors of emitted light, the lighting unit 105 includes a controller 115. Based on color control information 120, the example controller 115 turns on a corresponding combination of the LEDs 110-112 at respective intensities. In disclosed embodiments, the desired color control information 120 represents absolute or relative amounts of white (W), red (R), blue (B), and green (G). For example, if purple light is desired, the color control information 120 may represent equal amounts of red and blue, with the amount of blue and red reflecting the desired color saturation.

The LEDs and associated measurement sensor(s) 135 may be included in a calibration chamber that shields the measurement system from external light or other noise. The chamber can provide the LEDs at predefined distances from the sensor(s) 135 and may also shield the sensors from direct input from the LEDs (e.g., through translucent or opaque (for indirect lighting) filters).

The controller 115 may determine which of the LEDs 110-112 to turn on and at what intensities based on the following mathematical equations:

$$F(W)=W-k_{ww}W \quad (1)$$

$$F(R)=(R-k_{rr}R)+k_{rg}G+k_{rb}B+k_{rw}W \quad (2)$$

$$F(B)=(B-k_{bb}B)+K_{br}R+k_{bg}G+k_{bw}W \quad (3)$$

$$F(G)=(G-k_{gg}G)+k_{gr}R+k_{gb}B+k_{gw}W \quad (4)$$

where the coefficients:

| | | | |
|---|---|---|---|
| $k_{ww}$ | | | |
| $k_{rw}$ | $k_{rr}$ | $k_{rb}$ | $k_{rg}$ |
| $k_{bw}$ | $k_{br}$ | $k_{bb}$ | $k_{bg}$ |
| $k_{gw}$ | $k_{gr}$ | $k_{gb}$ | $k_{gg}$ |

are calibration coefficients 125 determined by a calibrator 130;

W, R, B and G collectively represent the desired color 120 to be emitted; and F(W), F(R), F(B) and F(G) represent the light intensity to be emitted by a white LED, a red LED, a blue LED and a green LED, respectively.

The calibration coefficients 125 represent the inter-dependence of the various colored LEDs in generating a particular desired color 120, and enable the use of one or more colored LEDs to compensate for a shift in color of another colored LED. For example, if a pure green color is desired (e.g., R=B=0), the expressions of Eqs. (1)-(4) also result in the blue LED and the red LEDs being turn on, according the values of $k_{bg}$ and $k_{rg}$, respectively. In this example, turning on of the red LED and the blue LED, in addition to the green LED, compensates for the color shift of the green LED. The lighting unit 105 includes any type of non-volatile memory 124 to store the calibration coefficients 125.

The example calibrator 130 of FIG. 1 determines for each particular lighting unit 105 the set of calibration coefficients 125 that calibrates that lighting unit 105 such that the lighting unit 105 emits substantially the same colored light as other lighting units 105 in response to identical color control information 120. Because the LEDs 110-112 in different lighting units 105 may have different color shifts, the calibrator 130 may compute a different set of calibration coefficients 125 for each lighting unit 105.

The calibrator 130 computes the calibration coefficients 125 during manufacturing and/or testing of the lighting unit 105, and stores the calibration coefficients 125 in the lighting unit 105 for subsequent use by the controller 115, as described above. The calibrator 130 may also compute and/or update the calibration coefficients 125 in situ when an LED 110-112 is replaced or to compensate for color shifts that may arise over time due to, for example, component aging. An example process that may be carried out by the calibrator 130 to compute the calibration coefficients 125 is described below in connection with FIG. 2.

Figure 3:
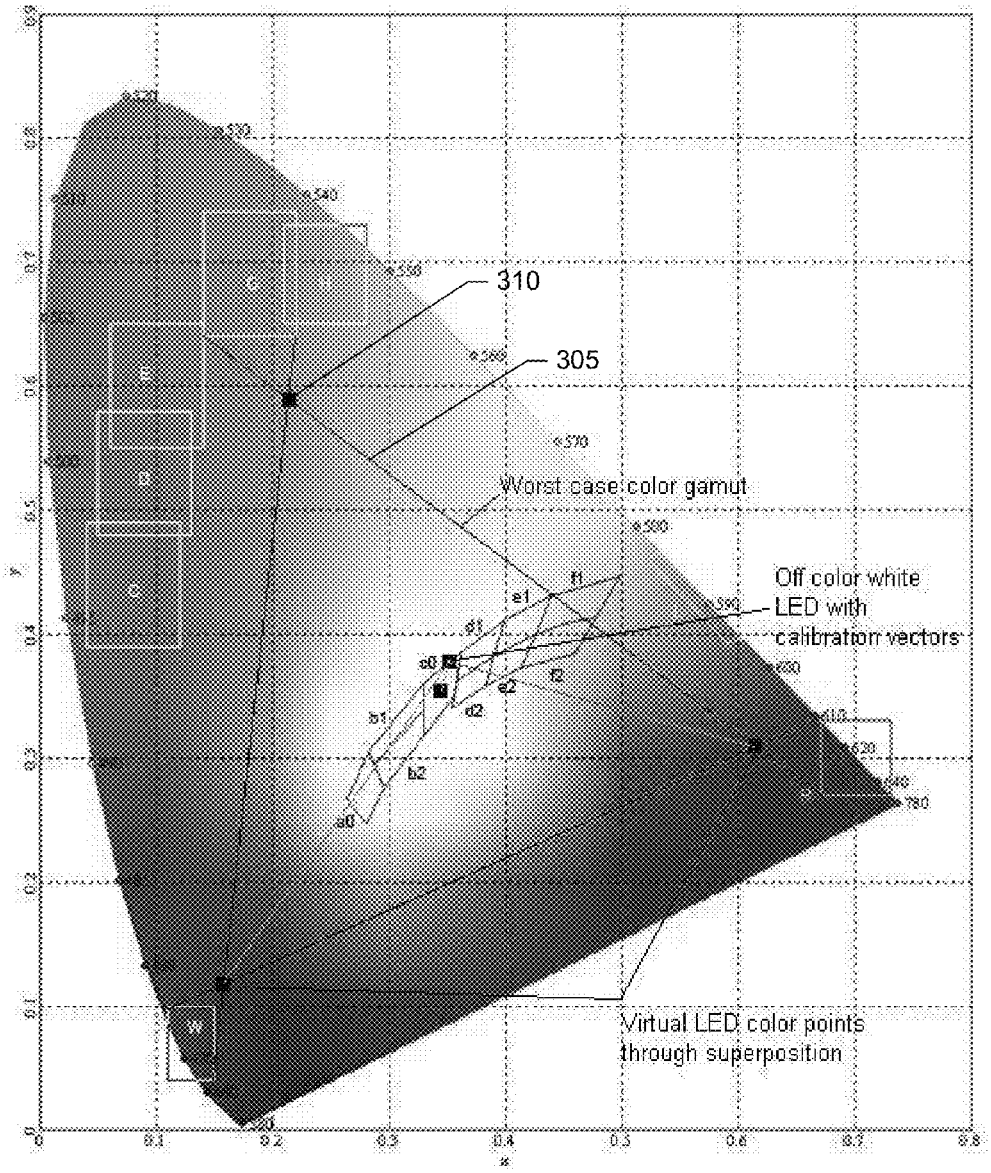
FIG. 3 is a chromaticity diagram illustrating an example operation of the example apparatus of FIG. 1.

FIG. 3 is a chromaticity diagram representing a gamut of colors that can be generated by the lighting unit 105. Worst case LED color shifts can be based on measured maximum variance values. Considering these worst case LED color shifts, a consistently realizable color gamut (depicted as triangle 305 in FIG. 3) can be determined, at least within predefined probabilities (e.g., p=98%, p=99.5%, p=99.99%, which would reflect the probability that any particular manufactured light unit could realize this color gamut). The realizable color gamut 305 represents the color gamut that every lighting unit 105 of a particular design can achieve regardless of the particular color shifts of any of the unit's LEDs 110-112. In other words, the realizable color gamut 305 is a color gamut that can be consistently achieved (and, thus, guaranteed) across lighting units 105. Vertices of the triangle 305 represent virtual primary colors. For example, the color corresponding to a vertex 310 would be generated in response to a request for a fully saturated primary green color. Because the vertices of the triangle 305 are different from the primary colors, each color in the color gamut contained inside the triangle 305 contains at least some red, green and blue.

Accordingly, the calibrator 130 selects the coefficients 125 such that for any color supported by the lighting unit 105 (i.e., any color inside the triangle 305), the lighting unit 105 always emits at least some red light, some green light and some blue light. That is, the calibrator 130 is configured to ensure that none of the coefficients 125 have a value of zero. By ensuring that at least some of all three colors are emitted, the calibrator 130 ensures that the light emitted by the lighting units 105 has consistent rendering and reflections and, thus, is perceived by humans as being consistent from lighting unit 105 to lighting unit 105. The color gamut 305 can be determined experimentally based on color shifts measured for a large number of LEDs. This number should be large enough so that statistically significant determinations of variance and overall population characteristics can be made with a predefined degree of certainty.

To measure or sense the color and intensity of light emitted by the lighting unit 105, the apparatus 100 includes any number and/or type(s) of light sensor(s), one of which is designated at reference numeral 135. The light sensor 135 provides one or more values 140 representative of the color and intensity of light emitted by the lighting unit 105 to the calibrator 130 for use in computing the calibration coefficients 125.

In an embodiment, the controller 115 adjusts the brightness of the LEDs 110-112 using pulse-width modulation (PWM)

with 1024 different modulation duty cycles, which can be represented by 10 bits, and 7-bit calibration coefficients 125. However, other resolutions (e.g., 8, 16, 24 bits, and floating point numbers, etc.) may be used to represent modulation duty cycles and/or coefficients. Because in Eqs. (1)-(4) the various contributing colors are multiplied by their associated coefficient 125, colors remain proportional, which ensures that resultant colors of the emitted light are independent of flux. As with any calibration method, there is a resolution limit and color contributions become negligible or disappear altogether as the requested brightness approaches zero, due to truncation. In real-life situations, such effects are normally not humanly perceptible and are inherent in any digital system. If a higher resolution is required, a lower starting value for white can be selected (e.g., 80% versus 90%), which will add one bit of effective resolution, but may degrade color rendering.

The calibrator 130 may be implemented by computer(s) or machine(s) having a processor, circuit(s), programmable processor(s) (controller 160), fuses, application-specific integrated circuit(s) (ASIC(s)), programmable logic device(s) (PLD(s)), field-programmable logic device(s) (FPLD(s)), field-programmable gate array(s) (FPGA(s)), etc. When any embodiment of this disclosure is interpreted to cover a purely software and/or firmware implementation, at least one of the components is expressly defined to include a tangible article of manufacture such as a tangible computer-readable storage medium storing machine-readable instructions such as the firmware and/or software.

Figure 2:
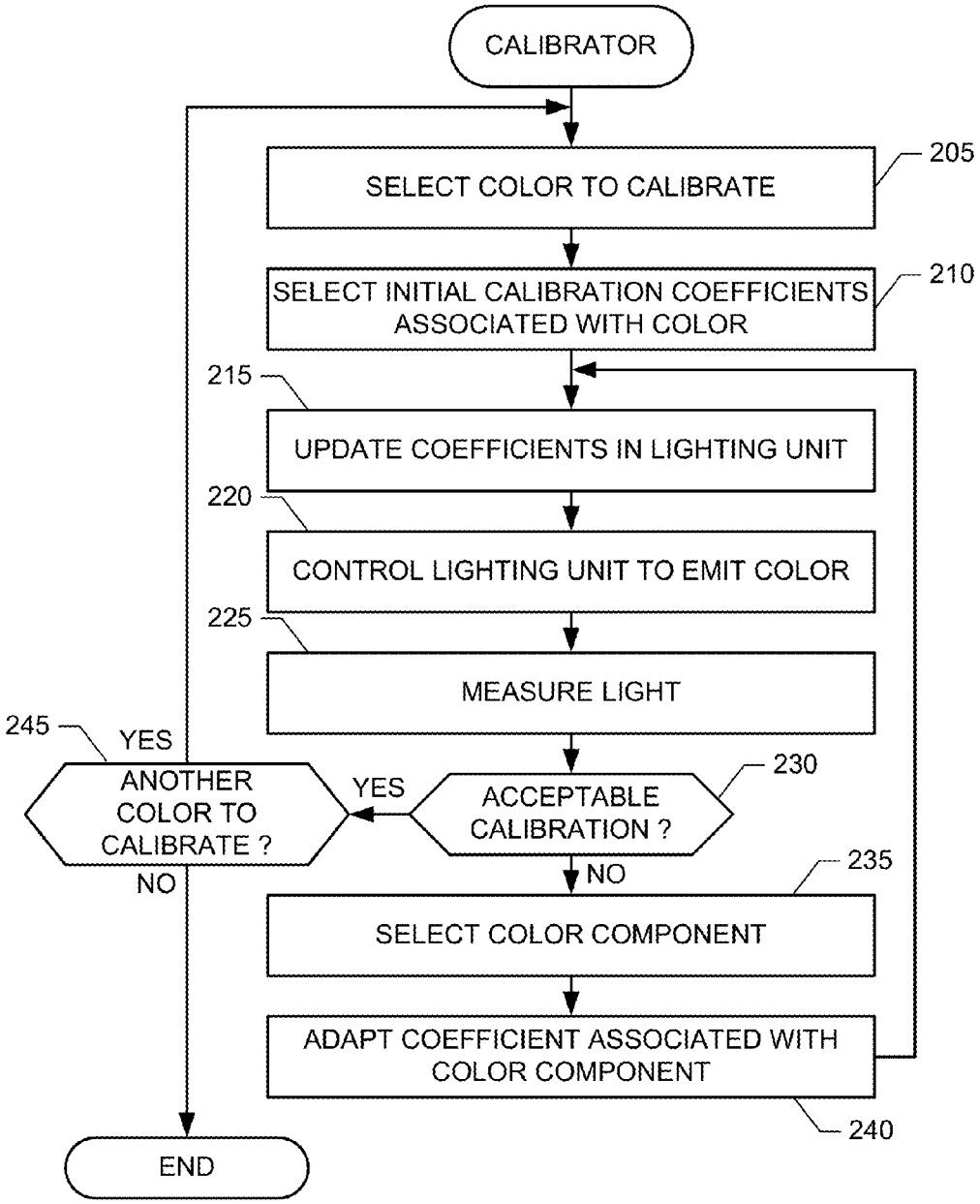
FIG. 2 is a flowchart illustrating an example process that may, for example, be embodied as machine-readable instructions executed by one or more processors to implement the example calibrator of FIG. 1.

FIG. 2 is a flowchart of an example process that may, for example, be implemented as instructions carried out by one or more processors to implement the example calibrator 130. The example process of FIG. 2 may be embodied in program code and/or computer-readable instructions stored on a tangible machine-readable medium accessible by a processor, a computer and/or other machine having a processor. Computer-readable instructions comprise, for example, instructions that cause a processor, a computer and/or a machine having a processor to perform one or more particular processes. Alternatively, some or all of the example process may be implemented using any combination of fuses, ASIC(s), PLD(s), FPLD(s), FPGA(s), discrete logic, hardware, firmware, or any combination thereof.

The example process of FIG. 2 begins with a target defining unit 145 of the calibrator 130 selecting a color to calibrate (block 205). In an example shown in FIG. 4, the calibrator 130 calibrates a white color and, in the example shown in FIG. 5, the calibrator 130 calibrates the virtual primary color 305 of FIG. 3. An assigning unit 150 of the calibrator 130 selects initial calibration coefficients 125 associated with selected color (block 210). For the example of FIG. 4, the calibrator 130 selects initial values for kww, krw, kgw, and kbw; and, for the example of FIG. 5, the calibrator 130 selects initial values for kgg, kgb and kgr. The calibrator 130 selects the initial coefficient values to represent particular default percentages that ensures that each calibrated color includes color emitted by each colored LED of the lighting unit 105. The default percentages can be determined experimentally based on color shifts measured for a large number of LEDs and the statistical variances associated with those measurements—the color shifts and associated percentages and variances may vary from LED manufacturer to LED manufacturer.

Figure 4:
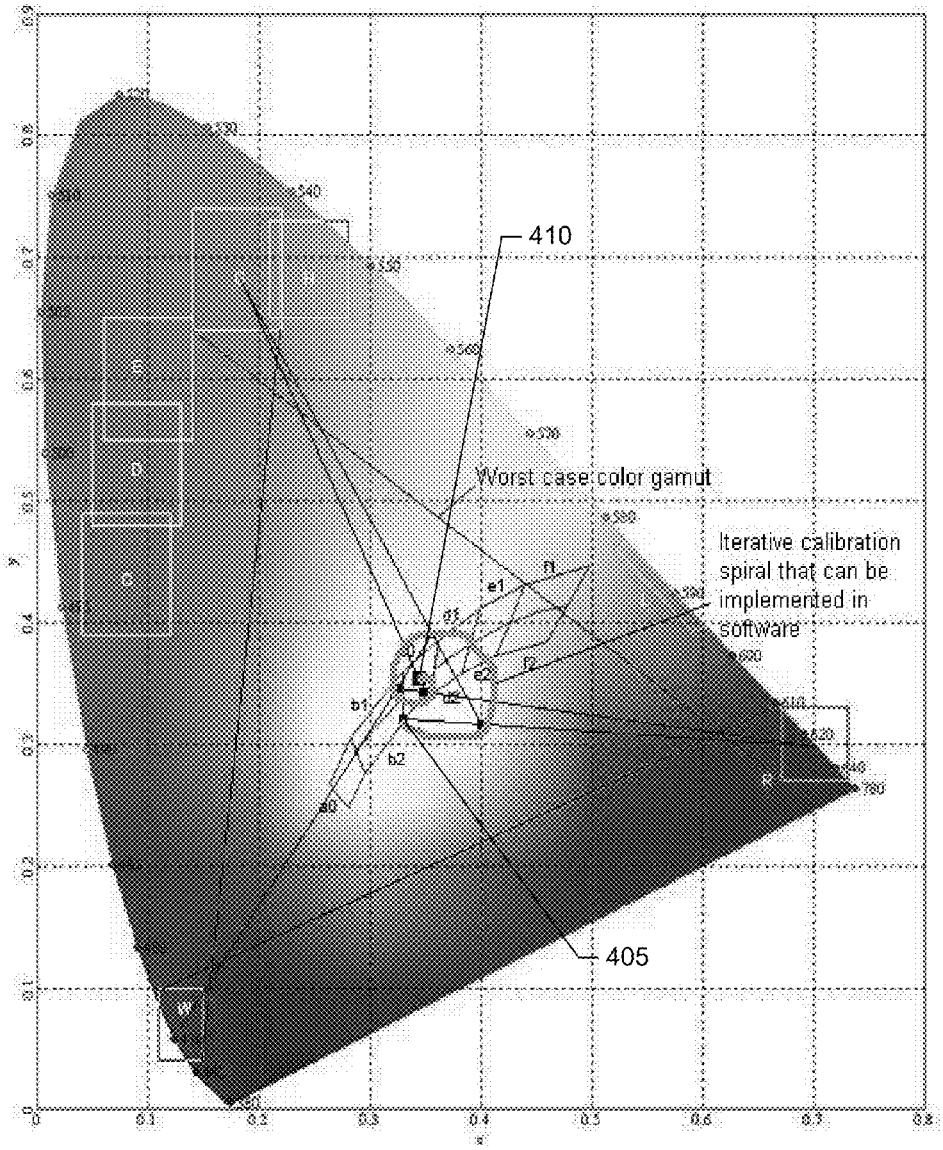
FIG. 4 is a chromaticity diagram illustrating an example operation of the example apparatus of FIG. 1 in which the apparatus spirals in to a centrally located target point.

The calibrator 130 updates the coefficients 125 in the lighting unit 105 (block 215), and controls the lighting unit 105 to emit the color being calibrated (block 220). The light sensor 135 measures the light emitted by the lighting unit 105 (block 225). In the example of FIG. 4, the light emitted by the lighting unit 105 is directed towards a central target point 405 and in the example of FIG. 5, the light emitted by the lighting unit 105 is directed toward a primary color target point 505.

If the light currently being emitted by the lighting unit 105 is not suitably close (suitably close being defined by some relatively objective criteria, e.g., based on the limits of human visual perception, and possibly defined in terms of MacAdam Ellipses or other form of objective measurement) to the desired color (block 230), a selection and adaptation unit 155 of the calibrator 130 selects a first color component to adjust (block 235). In the example of FIG. 4, the calibrator 130 selects the red component and, in the example of FIG. 5, selects the blue component.

The calibrator 130 adjusts the coefficient 125 associated with the selected color component to adjust the emitted light to be closer to the desired color (block 240). In the example of FIG. 4, the coefficient $k_{wr}$ is increased and, in the example of FIG. 5, the coefficient $k_{gb}$ is increased. Control then returns to block 215 to update the lighting unit 105 and re-measure the light being emitted. This process continues until acceptable calibration is achieved (block 230). As shown in FIG. 4, the calibration adaptively spirals toward the desired color 410. The reason for the spiral shape is to provide an organized sequence of operations in order to converge on the desired color point. Stepping in smaller and smaller increments (using less and less of each color) in each separate color generates a spiral inward towards the target color and creates a spiral path to the target color point. Use of this algorithm removes a need for more complex algorithms or error corrections due to an overshoot.

Figure 5:
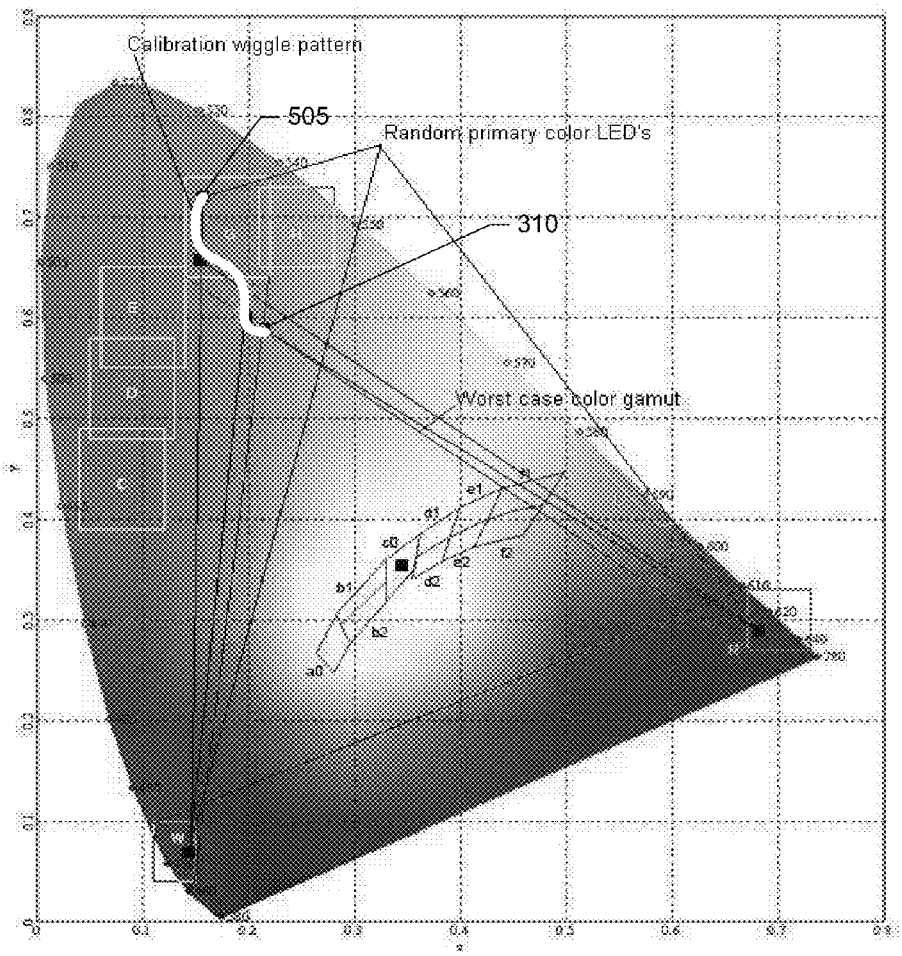
FIG. 5 is a chromaticity diagram illustrating an example operation of the example apparatus of FIG. 1 in which the apparatus zig-zags towards a primary color point.

In FIG. 5, the calibration adaptively moves in a winding path. The winding path is due to the fact that the system is converging on a point with only two other colors, and so it goes back and forth between the two colors toward the desired color.

When acceptable calibration for the selected color is achieved (block 230), the calibrator 130 determines whether other colors remain to be calibrated (block 245). For example, after calibrating white as shown in FIG. 4, green may be calibrated as shown in FIG. 5. If another color need to be calibrated (block 245), control returns to block 205 to calibrate the next color. When all colors have been calibrated (block 245), color exits from the example process of FIG. 2.

Once the lighting unit 105 has been calibrated, it can be installed in a vehicle adjacent to other similarly calibrated lighting units. Commands subsequently issued to the lighting units 105 to produce a particular color are interpreted utilizing their respective calibration coefficients 125. Although the LEDs of the lighting units 105 vary, by driving the LED units differently in the different lighting units 105 based on the calibration coefficients 125 stored within the unit, a consistent color and luminosity can be output.

The embodiments disclosed herein may include a tangible computer-readable storage medium for storing program data, a processor for executing the program data to implement the methods and apparatus disclosed herein, a communications port for handling communications with other devices, and user interface devices such as a display, a keyboard, a mouse, a display, etc. When software modules are involved, these software modules may be stored as program instructions or computer-readable codes, which are executable by the processor, on the tangible computer-readable storage medium.

As used herein, the terms "tangible computer-readable storage medium" and "non-transitory computer-readable storage medium" are defined to expressly exclude propagating signals and to exclude any computer-readable media on which signals may be propagated. However, a computer-readable storage medium may include internal signal traces, cables, wires and/or internal signal paths carrying signals thereon. Example tangible and/or non-transitory computer-readable medium may be volatile and/or non-volatile, and may include a memory, a memory device, a compact disc (CD), a digital versatile disc (DVD), a floppy disk, a read-only memory (ROM), a random-access memory (RAM), a programmable ROM (PROM), an electronically-programmable ROM (EPROM), an electronically-erasable PROM (EEPROM), an optical storage device, a magnetic storage device and/or any other device in which information is stored for any duration (e.g., for extended time periods, permanently, during buffering, and/or during caching) and which can be accessed by a processor, a computer and/or other machine having a processor. The computer-readable storage medium can also be distributed over network-coupled computer systems (e.g., be a network-attached storage device, a server-based storage device, and/or a shared network storage device) so that computer-readable code may be stored and executed in a distributed fashion. Such a media can be read by a computer, instructions thereon stored in a memory, and executed by a processor.

Any references, including publications, patent applications, and patents cited herein are hereby incorporated by reference to the same extent as if each reference were individually and specifically indicated to be incorporated by reference and were set forth in its entirety herein.

For the purposes of promoting an understanding of the principles of the disclosure, reference has been made to the embodiments illustrated in the drawings, and specific language has been used to describe these embodiments. However, no limitation of the scope of this disclosure is intended by this specific language, and this disclosure should be construed to encompass all embodiments that would normally occur to one of ordinary skill in the art in view of this disclosure.

Disclosed embodiments may be described in terms of functional block components and various processing steps. Such functional blocks may be realized by any number of hardware and/or software components configured to perform the specified functions. For example, disclosed embodiments may employ various integrated circuit components, e.g., memory elements, processing elements, logic elements, look-up tables, and the like, which may carry out a variety of functions under the control of one or more microprocessors or other control devices. Similarly, where disclosed elements are implemented using software programming, the disclosed software elements may be implemented with any programming or scripting language such as C, C++, Java, assembler, or the like, with the various algorithms being implemented with any combination of data structures, objects, processes, routines or other programming elements. Functional aspects may be implemented in algorithms that execute on one or more processors. Furthermore, the disclosed embodiments can employ any number of conventional techniques for electronics configuration, signal processing and/or control, data processing, and the like. The words "mechanism" and "element" are used broadly and are not limited to mechanical or physical embodiments, but can include software routines in conjunction with processors, etc.

The particular implementations shown and described herein are illustrative examples and are not intended to otherwise limit the scope of this disclosure in any way. For the sake of clarity, conventional electronics, control systems, software development and other functional aspects of the systems (and components of the individual operating components of the systems) may not be shown in the figures or described in detail. Furthermore, the connecting lines, or connectors shown in the various figures presented are intended to represent exemplary functional relationships and/or physical or logical couplings between the various elements. It should be noted that many alternative or additional functional relationships, physical connections or logical connections may be present in a practical device. Moreover, no item or component is essential to the practice of the disclosed embodiments unless the element is specifically described as "essential" or "critical".

The use of the terms "a" and "an" and "the" and similar references in the context of describing examples are to be construed to cover both the singular and the plural. Furthermore, any recitation of ranges of values herein are merely intended to serve as a shorthand method of referring individually to each separate value falling within the range, unless otherwise indicated herein, and each separate value is incorporated into the specification as if it were individually recited herein. The steps of all methods described herein can be performed in any suitable order unless otherwise indicated herein or otherwise clearly contradicted by context. Moreover, one or more of the blocks and/or interactions described may be changed, eliminated, sub-divided, or combined; or any or all of the process may be carried out sequentially and/or carried out in parallel by, for example, separate processing threads, processors, devices, discrete logic, circuits, etc. The use of any and all examples, or exemplary language (e.g., "such as" or "for example") provided herein, is intended merely to better illuminate aspects of the disclosure and does not pose a limitation on the scope of this disclosure unless otherwise claimed. Numerous modifications and adaptations will be readily apparent to those skilled in this art without departing from the spirit and scope of the disclosure.

While methods, apparatus and articles of manufacture to calibrate lighting units have been particularly shown and described with reference to exemplary embodiments thereof, it will be understood by those of ordinary skill in the art that various changes in form and details may be made therein without departing from the spirit and scope of this disclosure.

What is claimed is:

1. A method for calibrating a color LED light unit comprising at least first-, second-, and third-color LEDs, comprising:

a) defining a target color on a color map to calibrate;

b) selecting initial calibration coefficients associated with the target color;

c) storing: 1) the initial, or 2) updated calibration coefficients in a non-volatile memory of the light unit;

d) controlling the light unit with a controller to drive the LEDs to attempt to emit the target color, producing an attempted color, utilizing one of the initial and updated calibration coefficients;

e) measuring the attempted color to determine if it matches the target color within a predefined tolerance;

f) if the attempted color matches the target color, then terminating the method;

g) if the attempted color does not match the target color, then performing the following;

h.1) selecting a first color component;

i.1 adapting at least one calibration coefficient associated with the selected first color component by a first color component first amount;

j.1 a performing (c)-(g) again;

h.2) selecting a second color component that is different from the first color component;

i.2) adapting at least one calibration coefficient associated with the selected second color component by a second color component first amount;

j.2) performing (c)-(g) again;

h.3) selecting the first color component;

i.3) adapting the at least one calibration coefficient associated with the selected first color component by a first color component second amount that is smaller than the first color component first amount and avoids an overshoot of the target color;

i.3) performing (c)-(g) again;

h.4) selecting the second color component;

i.4) adapting the at least one calibration coefficient associated with the selected second color component by a second color component second amount that is smaller than the second color component first amount and avoids an overshoot of the target color;

j.4) performing (c)-(g) again;

wherein a path in a color space of the attempted colors forms: a) a converging winding path when only two color components are utilized; and b) a converging spiral when three color components are utilized.

2. The method according to claim 1, wherein the first color is red, the second color is blue, and the third color is green.

3. The method according to claim 2, wherein the LED light unit further comprises a white LED.

4. The method according to claim 3, wherein the controller determines which of the LEDs to turn on and at what intensities based on the following mathematical equations:

$$F(W)=W-k_{ww}W \tag{1}$$

$$F(R)=(R-k_{rr}R)+k_{rg}G+k_{rb}B+k_{rw}W \tag{2}$$

$$F(B)=(B-k_{bb}B)+K_{br}R+k_{bg}G+k_{bw}W \tag{3}$$

$$F(G)=(G-k_{gg}G)+k_{gr}R+k_{gb}B+k_{gw}W \tag{4}$$

where the coefficients:

| | | | |
|---|---|---|---|
| $k_{ww}$ | | | |
| $k_{rw}$ | $k_{rr}$ | $k_{rb}$ | $k_{rg}$ |
| $k_{bw}$ | $k_{br}$ | $k_{bb}$ | $k_{bg}$ |
| $k_{gw}$ | $k_{gr}$ | $k_{gb}$ | $k_{gg}$ |

are calibration coefficients determined by a calibrator and represent the inter-dependence of the various colored LEDs in generating a particular desired color;

W, R, B and G collectively represent the desired color to be emitted; and

F(W), F(R), F(B) and F(G) represent the light intensity to be emitted by a white LED, a red LED, a blue LED and a green LED, respectively.

5. The method according to claim 1, wherein the controlling of the light unit is performed using variations in a pulse width in a pulse-width-modulated (PWM) signal.

6. The method according to claim 5, wherein the variations comprise at least 1024 different values.

7. The method according to claim 1, wherein the initial and updated calibration coefficients are represented by 24-bit values.

8. The method according to claim 1, wherein the determining a color match comprises:

matching to a level that is indistinguishable to the human eye.

9. The method according to claim 1, wherein the determining a color match comprises:

matching to a predefined multiplier of a MacAdam Ellipse.

10. The method according to claim 1, further comprising:

performing (a)-(j) for one or more additional target colors.

11. The method according to claim 10, wherein at least three colors are used as target colors, and the three colors define a color gamut as three points of vertices of a triangle.

12. The method according to claim 11, wherein the vertices represent virtual primary colors.

13. The method according to claim 12, wherein the vertices require driving of the red, green, and blue LEDs with non-zero values.

14. A non-transitory computer program product, comprising a computer usable medium having a computer readable program code embodied therein, said computer readable program code adapted to be executed to implement the method according to claim 1.

15. A method for calibrating a color LED light unit comprising at least first-, second-, and third-color LEDs, comprising:

a) defining a target color on a color map to calibrate;

b) selecting initial calibration coefficients associated with the target color;

c) storing: 1) the initial, or 2) updated calibration coefficients in a non-volatile memory of the light unit;

d) controlling the light unit with a controller to drive the LEDs to attempt to emit the target color, producing an attempted color, utilizing one of the initial and updated calibration coefficients;

e) measuring the attempted color to determine if it matches the target color within a predefined tolerance;

f) if the attempted color matches the target color, then terminating the method;

g) if the attempted color does not match the target color, then performing the following;

h) selecting a color component;

i) adapting at least one calibration coefficient associated with the selected color component;

j) performing (c)-(i) again;

performing (a)-(j) for one or more additional target colors, wherein at least three colors are used as target colors, and the three colors define a color gamut as three points of vertices of a triangle;

measuring a statistically significant plurality of LEDs of each color class;

determining a variance for each color class LED;

defining a worst case color gamut within a predetermined probability; and defining the tree points to specifically bound the worst case color gamut.

16. A system for calibrating a color LED light unit, wherein:

the color LED light unit comprises:

at least first-, second-, and third-color LEDs; and a non-volatile memory; and the system comprises:

a) a target defining unit that defines a target color on a color map to calibrate;

b) an assigning unit that selects initial calibration coefficients associated with the target color and stores: 1) the initial, or 2) updated calibration coefficients in the non-volatile memory;

c) a controller that controls the light unit to drive the LEDs to attempt to emit the target color, producing an attempted color, utilizing one of the initial and updated calibration coefficients;

d) a sensor that measures the attempted color to determine if it matches the target color within a predefined tolerance; and e) a selection and adaption unit configured such that:

f) if the attempted color matches the target color, then the system ceases performing calibration;

g1) if the attempted color does not match the target color, then:

h1) a selection unit selects a first color component; and i1) an adaption unit adapts at least one calibration coefficient associated with the selected first color component by a first color component first amount;

(f) is performed again;

g2) if the attempted color does not match the target color, then:

h2) the selection unit selects a second color component that is different from the first color component; and i2) the adaption unit adapts at least one calibration coefficient associated with the selected second color component by a second color component first amount;

(f) is performed again;

g3) if the attempted color does not match the target color, then:

h3) the selection unit selects the first color component; and i3) the adaption unit adapts the at least one calibration coefficient associated with the selected first color component by a first color component second amount that is smaller than the first color component first amount;

(f) is performed again;

g4) if the attempted color does not match the target color, then:

h4) the selection unit selects the second color component; and i4) the adaption unit adapts the at least one calibration coefficient associated with the selected second color component by a second color component second amount that is smaller than the second color component first amount;

wherein a path in a color space of the attempted colors forms: a) a converging winding path when only two color components are utilized; and b) a converging spiral when only three color components are utilized.

* * * * *